US005283593A

United States Patent [19]

Wehl

[11] Patent Number: 5,283,593

[45] Date of Patent: Feb. 1, 1994

[54] INK RESERVOIR FOR INK PRINTER MEANS HAVING A MEANS TO PREVENT UNAUTHORIZED REFILLING

[75] Inventor: Wolfgang Wehl, Munich, Fed. Rep. of Germany

[73] Assignee: Mannesmann AG, Fed. Rep. of Germany

[21] Appl. No.: 646,617

[22] PCT Filed: Jul. 25, 1988

[86] PCT No.: PCT/DE88/00463

§ 371 Date: Jan. 24, 1991

§ 102(e) Date: Jan. 24, 1991

[87] PCT Pub. No.: WO90/00976

PCT Pub. Date: Feb. 8, 1990

[51] Int. Cl.[5] ..... B41T 2/17; B65D 47/02; H01H 9/00; H01H 35/34

[52] U.S. Cl. ..... 346/140 R; 340/618; 222/147; 137/885; 335/205; 200/83 R

[58] Field of Search ..... 346/140 R; 340/618; 222/147, 213, 96; 137/885, 886; 335/170, 205; 200/81 R, 83 L, 83 N, 83 R

[56] References Cited

U.S. PATENT DOCUMENTS

| | | | |
|---|---|---|---|
| 2,953,660 | 9/1960 | Bohn | 335/205 |
| 3,167,624 | 1/1965 | Jones, Jr. | 335/205 |
| 3,704,813 | 2/1972 | Devol | 222/147 |
| 4,253,103 | 2/1981 | Heinzl et al. | 346/140 R |
| 4,422,084 | 12/1983 | Saito | 346/140 R |
| 4,514,742 | 4/1985 | Suga et al. | 346/140 R |
| 4,604,633 | 8/1986 | Kimura et al. | 346/140 R |

FOREIGN PATENT DOCUMENTS

| | | | |
|---|---|---|---|
| 2610518 | 9/1977 | Fed. Rep. of Germany . | |
| 3037874C2 | 5/1982 | Fed. Rep. of Germany . | |
| 3422504A1 | 1/1986 | Fed. Rep. of Germany . | |
| 2133502 | 7/1984 | United Kingdom | 222/147 |

*Primary Examiner*—Benjamin R. Fuller
*Assistant Examiner*—David Yockey
*Attorney, Agent, or Firm*—Hill, Steadman & Simpson

[57] ABSTRACT

A replaceable ink reservoir for an ink printer [means comprises a means to] prevent unauthorized refilling and includes[. This means can be composed of] a magnetic contact element [(13)] arranged in the ink reservoir or [can be composed of] a clack valve arranged in the delivery region of the ink reservoir.

9 Claims, 1 Drawing Sheet

FIG 1
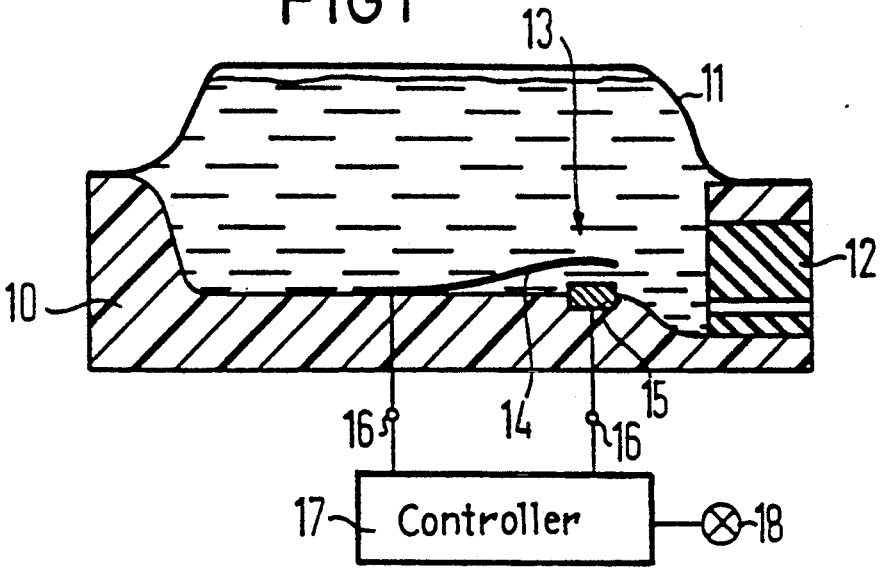
FIG 2
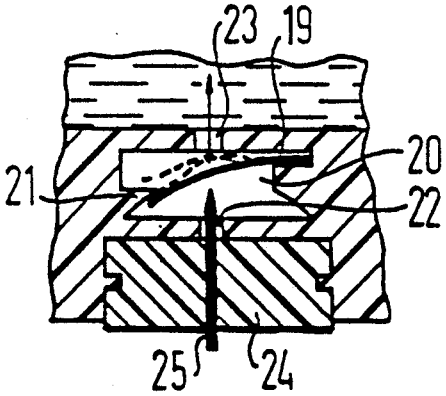
FIG 3
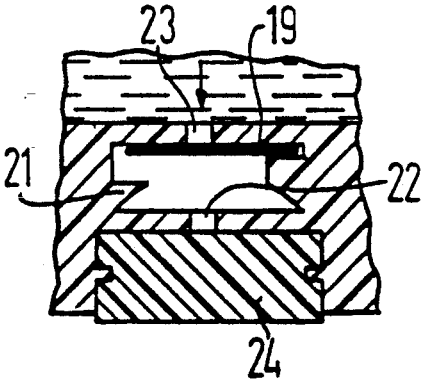
FIG 5
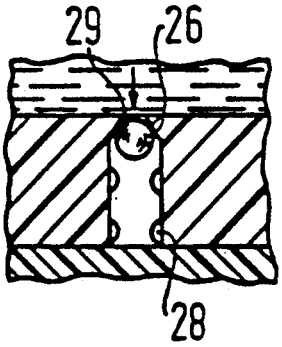
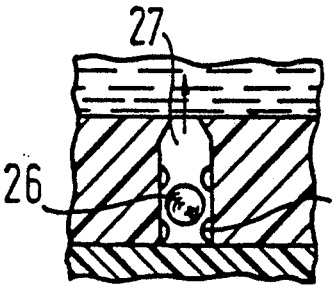
FIG. 4a
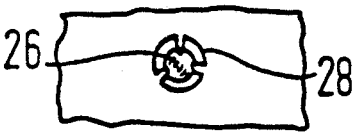
FIG. 4b

INK RESERVOIR FOR INK PRINTER MEANS HAVING A MEANS TO PREVENT UNAUTHORIZED REFILLING

BACKGROUND OF THE INVENTION

1. Field of the Invention

The invention is directed to an ink reservoir for ink printer means that can be coupled via a connecting region to the ink supply system of the ink printer means.

2. Description of the Related Art

In ink printer means, a print head moving along a recording medium is generally supplied with writing fluid from a supply bottle by an ink supply system. The printing head can be composed of a mosaic printing head in which a plurality of printing nozzles are arranged. Due to the contraction events occurring in these printing nozzles during writing mode, such a printing head automatically supplies itself with writing fluid from an ink reservoir. Such ink reservoirs are generally interchangeably fashioned (German AS 26 10 518).

Ink reservoirs for ink printer means are generally fashioned as one-way containers that are filled with ink in the factory and that dare not be re-employed after the ink supply has been used. A refilling of the ink reservoirs is not provided because this refilling harbors the risk that air will penetrate into the ink reservoir. Air bubbles contained in the ink lead to malfunctions of the printing operations, particularly when the ink printing equipment operates based on the under-pressure principle, a principle wherein the ink supply system has a slight under-pressure in comparison to the actual printing nozzle.

Whether bubble jet printing equipment or printing equipment operating according to the piezo-electric principle, ink printer equipment require ink fluid adapted thereto in terms of their composition. If used ink reservoirs are then again filled with ink of an unknown composition by outside manufacturers, then this can lead to malfunctions in the ink printing means. Such an uncontrolled refilling of used ink reservoirs must therefore be prevented.

U.S. Application No. 3,704,813 discloses a container for butane or liquefied gas that comprises a means that prevents a refilling of the container via the valve for safety reasons. To this end, a resilient mount for a closure element in the form of a ball is provided. After the actual filling event, the closing ball is separated from the mount and is irreversibly thrust in front of the filling opening of the container to be filled.

DE-A-34 22 504 also discloses a replaceable ink supply container of the species initially cited that comprises a contact element in the floor region that interacts with an elastic wall of the ink supply container.

SUMMARY OF THE INVENTION

It is an object (H the invention to fashion an ink reservoir of the species initially cited such that an unauthorized refilling of used ink reservoirs is prevented or, respectively, such that ink reservoirs that have been refilled without authorization can be recognized.

In an ink reservoir of the species initially cited, this object is achieved by the ink reservoir having a means for preventing refilling of the ink reservoir after it is used. In one embodiment, the means for preventing refilling of the ink reservoir includes an elastic wall on the ink reservoir and a contact element arranged inside the ink reservoir in the floor region thereof, this contact element interacting with the elastic wall of the ink reservoir such that, when a minimum ink volume is reached, the elastic wall of the collapsing ink reservoir moves the contact element into a contact position, the contact element being fashioned such that, after a minimum volume of the ink supply is reached, the contact element retains its contact position independently of refilling of the ink reservoir. The ink printer means also has a control arrangement that senses the contact position of the contact element and, dependent thereon, actuates an alarm means and/or suppresses the printer operation. The contact element is formed of two contact pieces, and, in a preferred embodiment, one of the two contact pieces is composed of magnetizable material, and the other contact piece is a magnetic element.

Alternately, the means for preventing refilling of the reservoir is a clack valve arranged in the connection region, the clack valve being fashioned such that, after an initial filling of the ink reservoir with the clack valve in an open condition, the clack valve closes the connection region such that only removal of ink fluid from the ink reservoir is possible. Preferrably, the clack valve comprises a movable closure element and has a latch mechanism for the closure element which has a latched position for the initial filling of the ink reservoir given that the closure element is in an open, interlocked position. After the initial filling of the ink reservoir, the closure element is brought into an operating position by irreversibly overcoming the interlocked position; the closure element then alternately seals and opens the connection to the ink reservoir dependent on the flow direction of the ink fluid.

In various embodiments, the clack valve is a flutter valve having an elastic seal element. Alternately, the clack valve is a movable ball which moves against a valve seat. Each of the foregoing embodiments may include a connection region of the ink reservoir closed by an elastic seal element that can be punctured by a hollow needle of the ink supply system of the ink printer means.

DESCRIPTION OF THE DRAWINGS

Embodiments of the invention are shown in the drawings and shall be set forth in greater detail below by way of example. Shown are:

FIG. 1 a schematic sectional view through an ink reservoir comprising a magnetic contact element arranged in the ink reservoir;

FIG. 2 a schematic sectional view of the connecting region of an ink reservoir comprising a clack valve accommodated therein that is fashioned as a flutter valve;

FIG. 3 a schematic sectional view of the clack valve of FIG. 2 in the operating condition.

FIGS. 4*a* and 4*b* a schematic sectional view and a bottom view of the connecting region of an ink reservoir comprising a clack valve with a ball as sealing element, shown in the filling condition; and FIG. 5 a schematic sectional view of the clack valve of FIGS. 4*a* and 4*b* in the operating condition.

DETAILED DESCRIPTION OF THE INVENTION

FIG. 1 shows a sectional view of an ink reservoir that is structurally connected to a printer head (not shown here) of an ink printer ideals. The structure of the ink reservoir fundamentally corresponds to the ink reservoir disclosed by German Patent 26 10 518. It comprises a well-shaped supporting member 10 that is covered with an elastic bubble foil 11 composed, for example, of polyethylene. Further, the ink reservoir comprises a removal opening having an elastic seal element 12 arranged therein that is punctured by a hollow needle when the ink reservoir is introduced into the receptacle means (not shown here) of the ink printer means. The ink fluid is situated in the cavity formed by the supporting member 10 and the bubble foil 11. Further, a contact element 13 is arranged at the floor of the ink reservoir within the well-shaped supporting member 10. The contact element is composed of a contact spring 14 of magnetizable material, for example stainless steel. A magnetic element 15 of, for example, soft iron is arranged in the swivel range of the contact spring 14 as cooperating contact for the contact spring 14. The contacting path in this case is composed of the contact spring 14 and the magnetic element 15. Via contact pins 16 and via a receptacle means (not shown here) for the ink reservoir, the contact element is connected to the controller 17 of the ink printer means that monitors the contacting distance in view of its contact position.

The contact is opened in the filled condition of the ink reservoir (FIG. 1).

In the emptied condition of the ink reservoir, the bubble foil 11 presses the contact spring 14 down and thus brings it into the range of influence of the magnetic cooperating contact 15, whereupon the contact is closed. This closed contact is recognized by the controller means 17 of the ink printer means and an alarm means in the form, for example, of a warning light 18 is actuated. Simultaneously, further operation of the ink printer means is suppressed.

Due to the magnet, the closed condition of the contact spring is preserved even after a potential refilling. Even after the refilling, the control means 17 recognizes the closed contact and continues to report the introduction of such a refilled ink reservoir as "end of ink". The warning lamp 18 is activated and the resumption of printing operations is prevented via the controller 17.

So that no disturbances arise during initial filling of the ink reservoir upon manufacture in the factory, the contact element can be integrated in the actuated condition during assembly of the ink reservoir. After the initial filling of the ink reservoir, the ink reservoir is exposed to a strong external magnetic field that opposes the action of the magnetic element 15 and thus brings the contact spring 14 away from the magnetic element and into the operating position.

In order to prevent corrosion at the contact parts, the contact parts of the contact elements can be coated with a protective layer that must be conductively fashioned in the contacting region or it is possible to add a protective means to the ink fluid.

In the exemplary embodiment of FIGS. 2 through 5, a clack valve is arranged in the connecting region of the ink reservoir, this clack valve being fashioned such that the clack valve closes the connecting region after an initial filling of the ink reservoir with open valve such that only a removal of ink fluid from the ink reservoir via the connecting region is possible.

In the exemplary embodiment of the clack valve according to FIG. 2, the clack valve has a movable closure element 19 for this purpose that acts in the form of a flutter valve. It is secured on one side in a recess of the supporting member 10 and is composed of an elastic membrane composed, for example, of plastic. The recess 20 of the supporting member contains a catch mechanism having a catch element 21 and is closed toward the outside of the ink reservoir except for a central ink removal opening 22. A corresponding removal opening 23 is situated in the partition between the recess 20 and the actual ink reservoir area filled with ink. The connection region and, thus, the clack valve is covered via a seal element 24 of rubber that is punctured by a hollow needle 25 allocated to the ink printer means when the ink reservoir is introduced into the acceptance mechanism of the ink printer means.

The clack valve thereby operates as follows: Upon initial filling, the membrane-like closure element 19 is in the interlocked position shown in FIG. 2. In this position, the closure element 19 can have ink fluid flow laterally around it whereby the ink fluid is supplied via the hollow needle 25 that is only half-introduced or is supplied directly via the opening 22. The ink fluid flows around the closure element 19 and thus fills the actual ink reservoir area.

After the complete filling of the ink reservoir, the hollow needle 25 is inserted farther into the ink reservoir. It thereby presses the closure element 19 past the latch element 21, so that the closure element 19 comes into the operating position shown in FIG. 3 in which it covers the inner access opening 23 to the ink reservoir in the fashion of a flutter valve.

When locking the ink reservoir in the ink printer means, the hollow needle 25 penetrates the seal element 24 and ink can be removed from the ink reservoir in the arrow direction. When an attempt is made to refill the ink reservoir by supplying ink from the outside to a used ink reservoir, then this is prevented by the elastic closure element 19. On the basis of an appropriate selection of the size of the openings 23 and 22 and of their covering by the corresponding side walls of the cavity 20, the closure element can likewise not be brought back into the initial position illustrated in FIG. 2 without disruption of the overall ink reservoir, the closure element 19 being locked behind the latch element 21 in this initial position. A refilling of an emptied and used ink reservoir is thus prevented.

In the exemplary embodiment of FIGS. 4*a*, 4*b*, and 5, the closure element is composed of a steel ball 26 that can be displaced within a central opening 27. Upon initial filling of the ink reservoir, the ball 26 is situated in a catch mechanism composed of a holding mechanism 28 of plastic that loosely embraces the ball, this holding mechanism 28 being of such a nature that the ball can have ink fluid flow around it in arrow direction. After the filling of the ink reservoir, the ball 26 is brought into the operating position to be seen in FIG. 5, being brought thereinto, for example, via the hollow needle 25 upon introduction of the ink reservoir into the ink printer means. It thereby overcomes the catch mechanism 28 and is seated in the region of the concentrically fashioned connecting opening 29 to the ink supply region of the ink reservoir. It acts as a clack valve therein, so that ink can only be removed in the illustrated arrow direction. When ink is supplied from the outside, the ball 26 closes the opening 29.

Although other modifications and changes may be suggested by those skilled in the art, it is the intention of the inventor to embody within the patent warranted hereon all changes and modifications as reasonably and properly come within the scope of his contribution to the art.

I claim:

1. A replaceable ink reservoir for an ink printer having an ink supply system, sad ink reservoir including a floor region and an elastic wall that collapses toward the floor region as ink is withdrawn, comprising:

a connecting region of the ink reservoir capable of being connected to the ink supply system; and means for preventing re-use of the ink reservoir after the ink reservoir is used and refilled, said means for preventing reuse includes:

a contact element arranged inside the ink reservoir in the floor region thereof, said contact element interacting with the elastic wall of the ink reservoir such that the collapsing elastic wall of the ink reservoir moves said contact element into a contacting position to actuate said contact element when a minimum volume of ink in the ink reservoir is reached, said contact element including means for retaining the contacting position after reaching the minimum volume of the ink supply system regardless of a refilling of the ink reservoir; and a control arrangement allocated to the ink printer to acquire the contacting position of said contact element.

2. An ink reservoir according to claim 1, wherein one side of said contact element is composed of magnetizable material; and further comprising:

a magnetic element arranged opposite another side of said contact element.

3. An ink reservoir according to claim 1, further comprising: means for preventing refilling of the ink reservoir, comprising:

a clack valve arranged in the connecting region, said clack valve including a closure element that is movable from an open position to a closed position and an opening that is closable by sad closure element when said closure element is in said closed position and fluid flow is attempted in an inward direction into said ink reservoir, said closure element being in said open position for an initial filling of the ink reservoir, said closure element of the clack valve being in said closed position to close said opening in the connecting region during use of said ink reservoir such that only removal of ink fluid from the ink reservoir is possible.

4. An ink reservoir according to claim 3, further comprising:

a latch means for holding said closure element in a latched position for initial filling of the ink reservoir, release means for moving said closure element to an irreversible released position, said latch means preventing return of said clack valve to the latched position after movement to said released position so that said clack valve alternately opens and closes a fluid passageway to the ink reservoir dependent on a flow direction of the ink fluid through said fluid passageway after initial filling of the ink reservoir.

5. An ink reservoir according to claim 4, wherein said closure element comprises a movable ball.

6. An ink reservoir according to claim 1, comprising: an elastic seal element closing said connecting region of the ink reservoir that is punctured by a hollow needle of the ink supply system of the ink printer means.

7. An ink reservoir as claimed in claim 1, further comprising:

alarm means responsive to said control arrangement for indicating an alarm condition when said control arrangement determines that said contacting element is in said contacting position.

8. An ink reservoir as claimed in claim 1, further comprising:

means responsive to said control arrangement for suppressing printer operation when said control arrangement determines that said contacting element is in said contacting position.

9. A replaceable ink reservoir for an ink printer having an ink supply system, comprising: a connecting region of the ink reservoir capable of being connected to the ink supply system; and means for preventing refilling of the ink reservoir after the ink reservoir is used, said means for preventing comprising a clack valve arranged in said connecting region, said clack valve including a closure element movable from an open position to a closed position and an opening that is closable by said closure element when said closure element is in said closed position so that, after an initial filling of the ink reservoir with said closure element open, said closure element of said clack valve closes said opening in said connecting region such that only removal of ink fluid from the ink reservoir is possible, a latch means for holding said closure element in a latched position for initial filling of the ink reservoir, means for moving irreversibly said closure element in said latch means from the latched position after an initial filling of the ink reservoir so that said clack valve alternately opens and closes a fluid passageway to the ink reservoir dependent on a flow direction of the ink fluid through said fluid passageway said closure element comprising a flutter valve having an elastic seal element.

* * * * *